US009180481B2

(12) United States Patent
Sargent

(10) Patent No.: US 9,180,481 B2
(45) Date of Patent: Nov. 10, 2015

(54) PROGRAMMABLE PAINT STATION

(71) Applicant: David Sargent, Madison, WI (US)

(72) Inventor: David Sargent, Madison, WI (US)

( * ) Notice: Subject to any disclaimer, the term of this patent is extended or adjusted under 35 U.S.C. 154(b) by 0 days.

(21) Appl. No.: 13/905,982

(22) Filed: May 30, 2013

(65) Prior Publication Data

US 2014/0352613 A1 Dec. 4, 2014

(51) Int. Cl.

| | |
|---|---|
| ***B05B 3/00*** | (2006.01) |
| ***B05B 15/04*** | (2006.01) |
| ***B41J 3/00*** | (2006.01) |
| ***B05C 15/00*** | (2006.01) |
| ***B05C 5/02*** | (2006.01) |

(52) U.S. Cl.
CPC .. *B05C 5/02* (2013.01); *B05C 15/00* (2013.01)

(58) Field of Classification Search
CPC ..... B41J 3/4078; D06P 5/30
USPC ..... 118/326, 313–315, 312, 323; 347/20, 347/21, 22, 29, 100, 4, 104, 105; 235/375
See application file for complete search history.

(56) References Cited

U.S. PATENT DOCUMENTS

| | | | | |
|---|---|---|---|---|
| 4,423,676 | A | 1/1984 | Neel | |
| 4,864,966 | A | 9/1989 | Anderson | |
| 5,757,407 | A * | 5/1998 | Rezanka | 347/102 |
| 6,095,628 | A * | 8/2000 | Rhome | 347/4 |
| 6,702,894 | B2 * | 3/2004 | Lee et al. | 118/325 |
| 7,422,384 | B2 * | 9/2008 | Schalk et al. | 400/88 |
| 7,607,745 | B2 * | 10/2009 | Ben-Zur | 347/2 |
| 2006/0066662 | A1 * | 3/2006 | Kadomatsu et al. | 347/21 |
| 2007/0031603 | A1 * | 2/2007 | Eron | 427/372.2 |
| 2009/0120309 | A1 | 5/2009 | Szyszko | |
| 2011/0242189 | A1 * | 10/2011 | Okada et al. | 347/20 |

* cited by examiner

*Primary Examiner* — Yewebdar Tadesse

(57) ABSTRACT

A paint station may include a frame with a table attached to it. A track may run along the length of the table. A bridge may be connected to the track and may move along the track. The bridge may extend across the width of the table. A painting component may be attached to the bridge and may move along the bridge. Therefore the painting component may run along two axes over the table. A computer may be connected to the paint station to direct the movement of the painting component along the two axes. A user may place a clothing apparel on the table and may input a command to paint a desired design on the clothing apparel.

16 Claims, 4 Drawing Sheets

PROGRAMMABLE PAINT STATION

BACKGROUND OF THE INVENTION

The present invention relates to paint station and, more particularly, to a portable programmable paint station for adding designs to apparel.

Currently, it is desirable to acquire a shirt with a design as opposed to a shirt that is plain. The most common form of commercial T-shirt decoration is screen-printing. In screen-printing, a design is separated into individual colors. Plastisol or water based inks are applied to the shirt through mesh screens which limits the areas where ink is deposited. However, this is generally done in screen printing factories and the consumers are unable to develop and apply unique painted artwork to their personal clothing.

As can be seen, there is a need for a portable and programmable paint station.

SUMMARY OF THE INVENTION

In one aspect of the present invention, a paint station comprises: a frame support; a table having a length and a width, wherein the table is suspended on the frame support; a track having a first end and a second end, wherein the track runs along at least a portion of the length of the table; a bridge having a first end and a second end, wherein the first end is movably attached to the track, wherein the bridge extends across at least a portion of the width of the table, wherein the bridge is configured to move between the first end of the track and the second end of the track; a printing component movably attached to the bridge, wherein the printing component is configured to move between the first end of the bridge and the second end of the bridge; at least one motor operatively connected to the bridge and the printing component, wherein the at least one motor drives the movement of the bridge along the track and drives the movement of the printing component along the bridge; and at least one processor operatively connected to the bridge and printing component, wherein the at least one processor controls the movement of the bridge along the track and the at least one processor controls the movement of the printing component along the bridge.

These and other features, aspects and advantages of the present invention will become better understood with reference to the following drawings, description and claims.

DETAILED DESCRIPTION OF THE INVENTION

Figure 1:
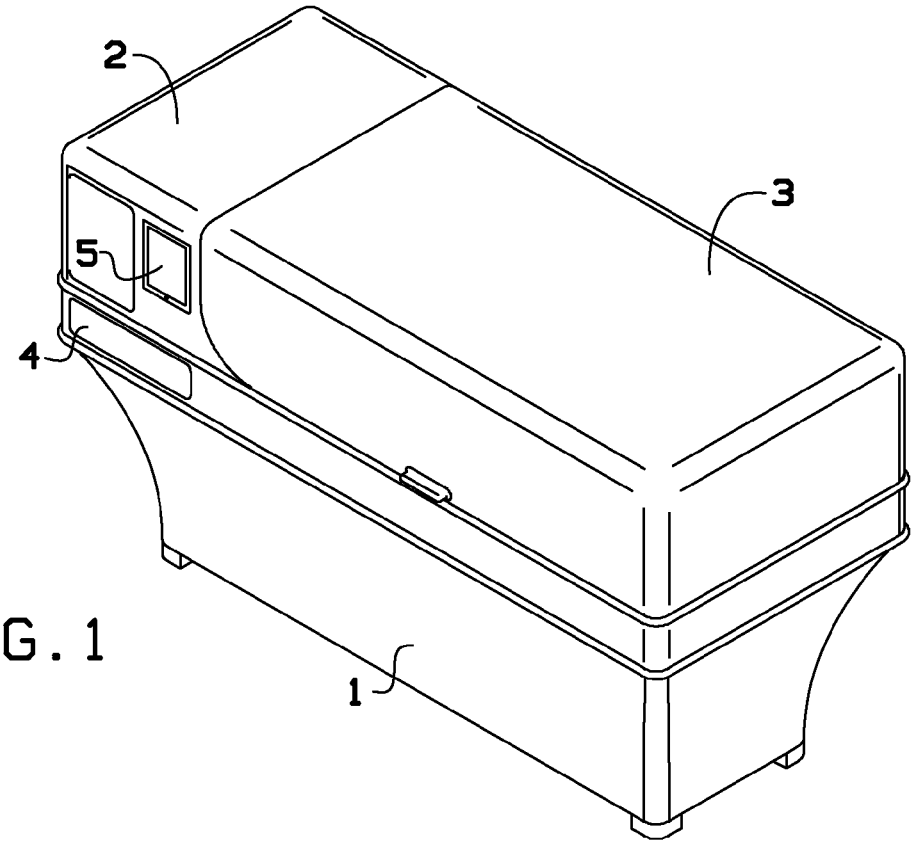
FIG. 1 is a perspective view of the present invention.
Figure 2:
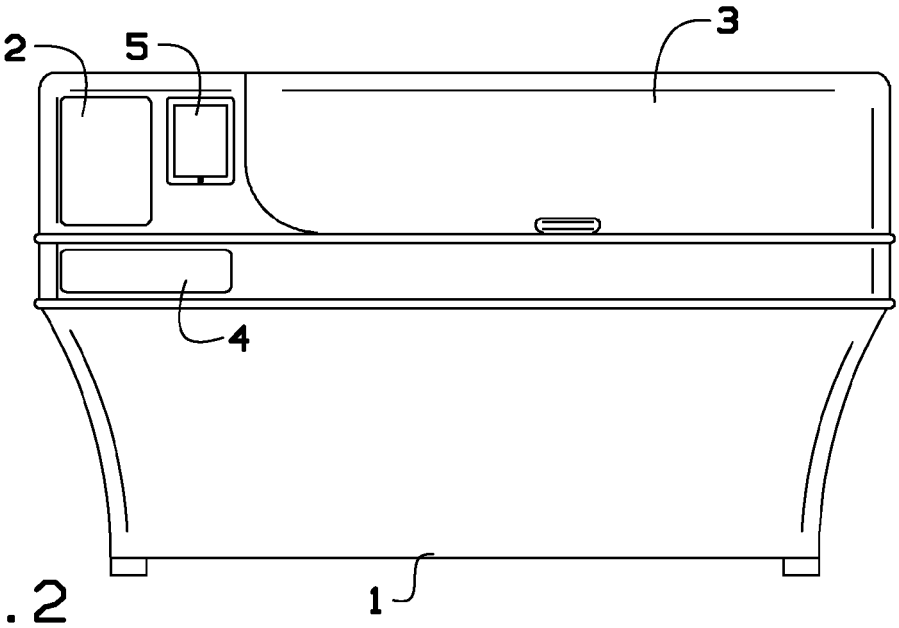
FIG. 2 is a front view of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an all encompassing paint station. The paint station may include a frame with a table attached to it. A track may run along the length of the table. A bridge may be connected to the track and may move along the track. The bridge may extend across the width of the table. A painting component may be attached to the bridge and may move along the bridge. Therefore the painting component may run along two axes over the table. A computer may be connected to the paint station to direct the movement of the painting component along the two axes. A user may place a clothing apparel on the table and may input a command to paint a desired design on the clothing apparel.

The present invention may include a portable custom automated textile painting machine. The present invention may provide a safe, professional, and easily accessible device for users, such as customers, to develop and apply unique painted artwork to their personal clothing. The present invention may be used in the back-room of a clothing store, within a mall open-space environment, or may even be used at home.

The programmable airbrush paint station may be an assembly that permits the application of airbrushed designs onto selected locations of clothing. The present invention may incorporate the following: a programmable wireless interface to provide process instruction and control; redundant mechanical process control; automated 2-axis robotic system to route the spray operation; automated system to provide spray delivery along with robotic control interchangeable paint options; air pressure to support the air brush mechanics; and a vacuum system to maintain a safe, clean exhaust.

Referring to claims 1 through 9, the present invention may include a programmable airbrush paint station. The station may include an outer shell. The outer shell may include a main body outer panel 1 and a hood outer panel 2. The main body outer panel 1 may shield the lower components of the present invention, while the hood outer panel 2 may shield the upper components of the present invention. The outer shell may be supported by and surround a frame 6. The frame 6 may include the main body in which the main body outer panel 1 may be attached, and a frame hood 7 in which the hood outer panel 2 is attached. The main body frame 6 may comprise an edge support 8, in which a table 9 for placing the clothing article 38 is secured. A shield 3 may be hinged to the edge support 8 of the main body frame 6 by a hinge 40 and may be in an open and a closed position. The open position may give a user access of the table 9.

The present invention may include a printing component. The printing component may include a mechanical arm 23 and an ink tray assembly 24. The printing component may be connected to a track 20 that may run the length of the table 9 and into the hood outer panel 2. The printing component may run along the track 20 when the device is activated. In certain embodiments, the track 20 may include a first rail and a second rail on either side of the table 9. A bridge 21 connects the printing component to the track 20 and may suspend the printing component in between the rails. At least one motor may drive the movement of the bridge 21 along the track 20. The bridge 21 may extend across the width of the table. In certain embodiments, the bridge 21 may have a first side attached to the first rail and a second side attached to the second rail.

In certain embodiments, the mechanical arm 23 may be movably attached to the bridge 21 by a neck assembly 22. The neck assembly 22 may move the mechanical arm 23 between the first side of the bridge 21 and the second side of the bridge 21. At least one motor may drive the movement of the mechanical arm 3 along the bridge 21. The ink tray assembly 24 may be attached to the bridge 21 in between the first side and the second side of the bridge 21. The ink tray assembly 24 may hold a plurality of ink cartridges 31, such as paint bottles. Therefore, the mechanical arm 23 may move along the bridge 21 and engage different ink cartridges 31 to load the mechanical arm 23 with different colors when needed.

The mechanical arm 23 may include a pivoting base 27 connected to a siphon arm 33. The siphon arm 33 may include a siphon head 42. When activated the siphon arm 33 may pivot at the pivoting base 27 and the siphon head 42 may engage the ink cartridge 31 and siphon the appropriate amount of ink. The mechanical arm 23 may further include an engaging clamp 30. The engaging clamp 30 may be attached to the mechanical arm 23 near the pivoting base 27. A gear sprocket 28 may be fastened to the pivoting base 27 by plurality of rivets 32. The gear sprocket 28 may actuate the engaging clamp 30. When the gear sprocket 28 actuates the engaging clamp 30, the mechanical arm 23 may secure the ink cartridge 31 in place and the siphon head 42 may engage the ink cartridge 31. In certain embodiments, a link bar 29 may connect the engaging clamp 30 to the gear sprocket 28 to provide more range for the mechanical arm 23. The mechanical arm 23 may further include an air brush 41.

Figure 4:
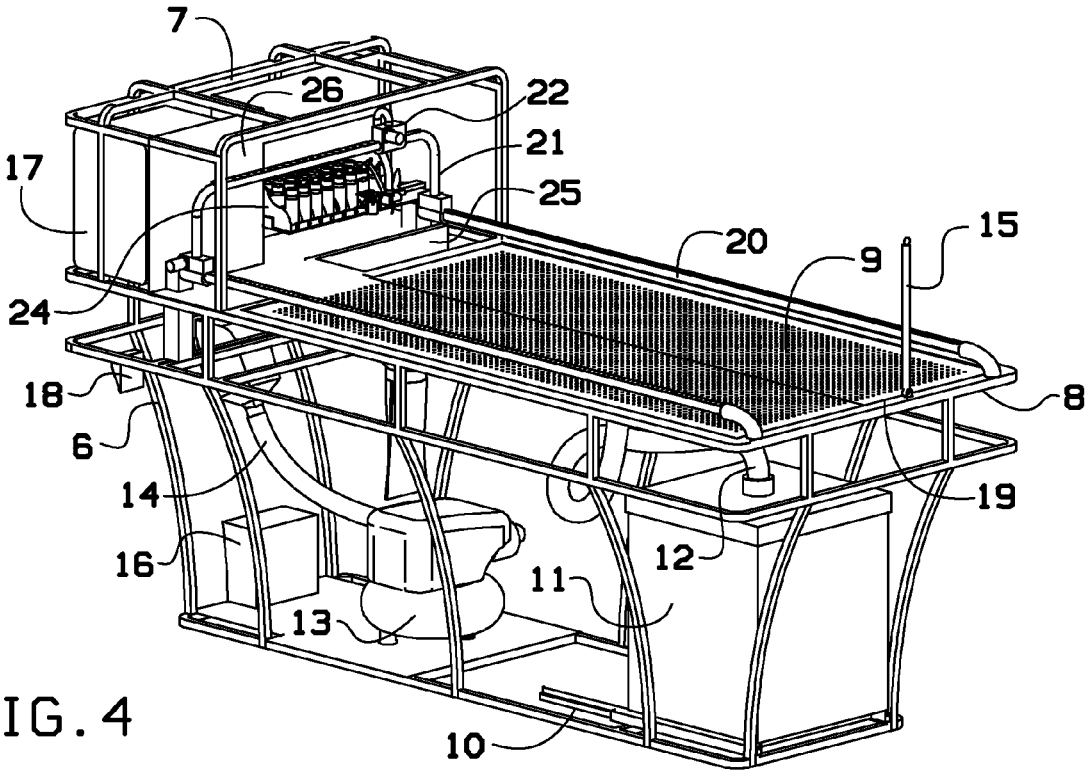
FIG. 4 is a perspective view of the present invention illustrated with exterior components of FIG. 1 omitted for illustrative clarity.
Figure 7:
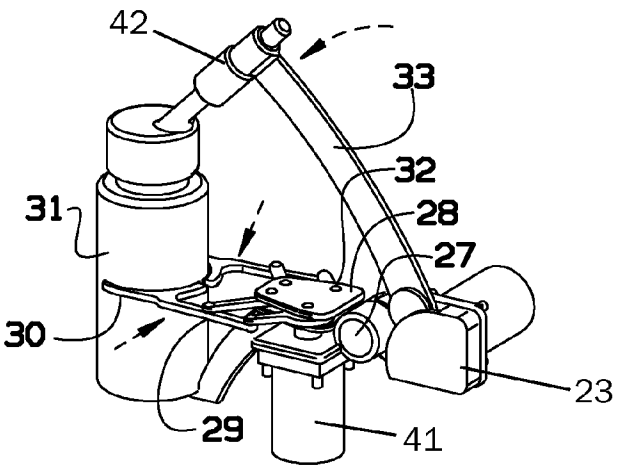
FIG. 7 is a perspective detail view of the mechanical arm assembly of FIG. 1 shown in an engaged configuration.
Figure 6:
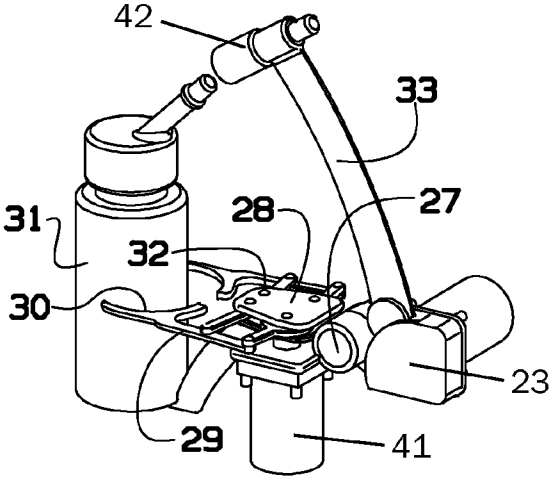
FIG. 6 is a perspective detail view of the mechanical arm assembly of FIG. 1 shown in a disengaged configuration.
Figure 5:
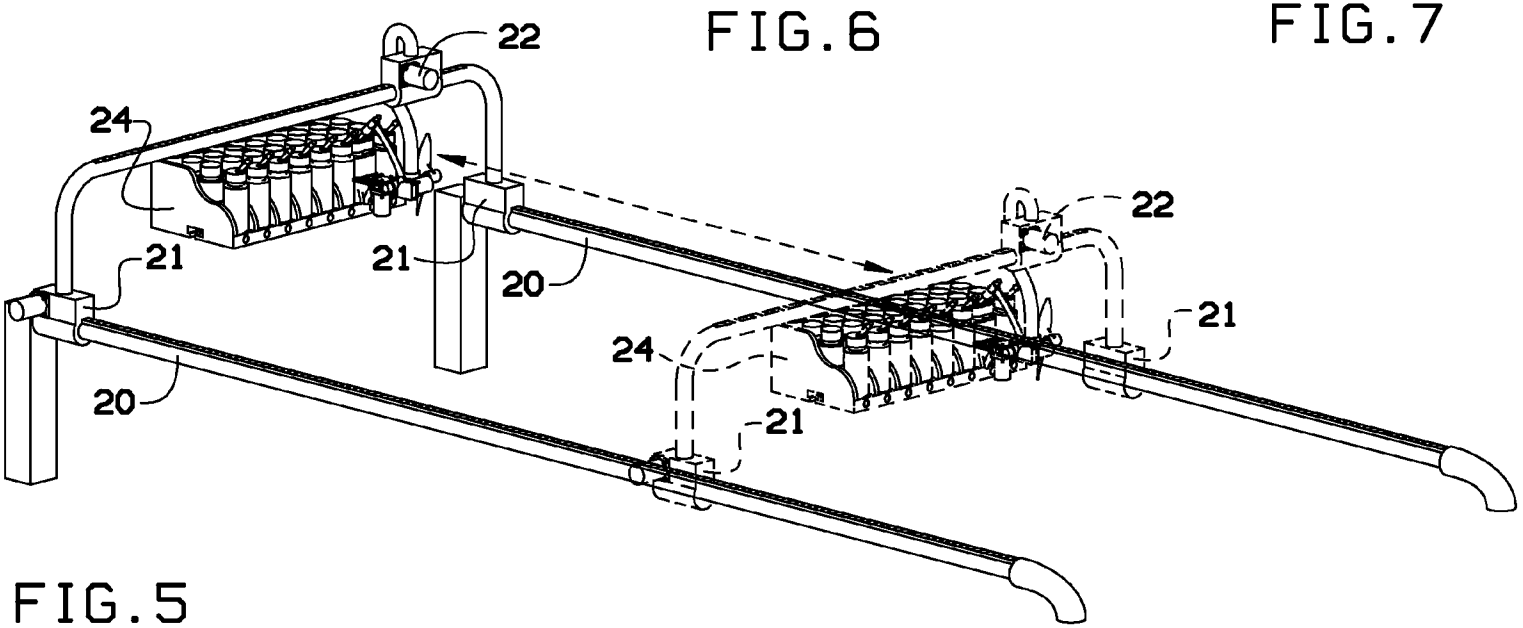
FIG. 5 is a perspective detail view of the present invention illustrating interior mechanical components of the embodiment of FIG. 1.
Figure 9:
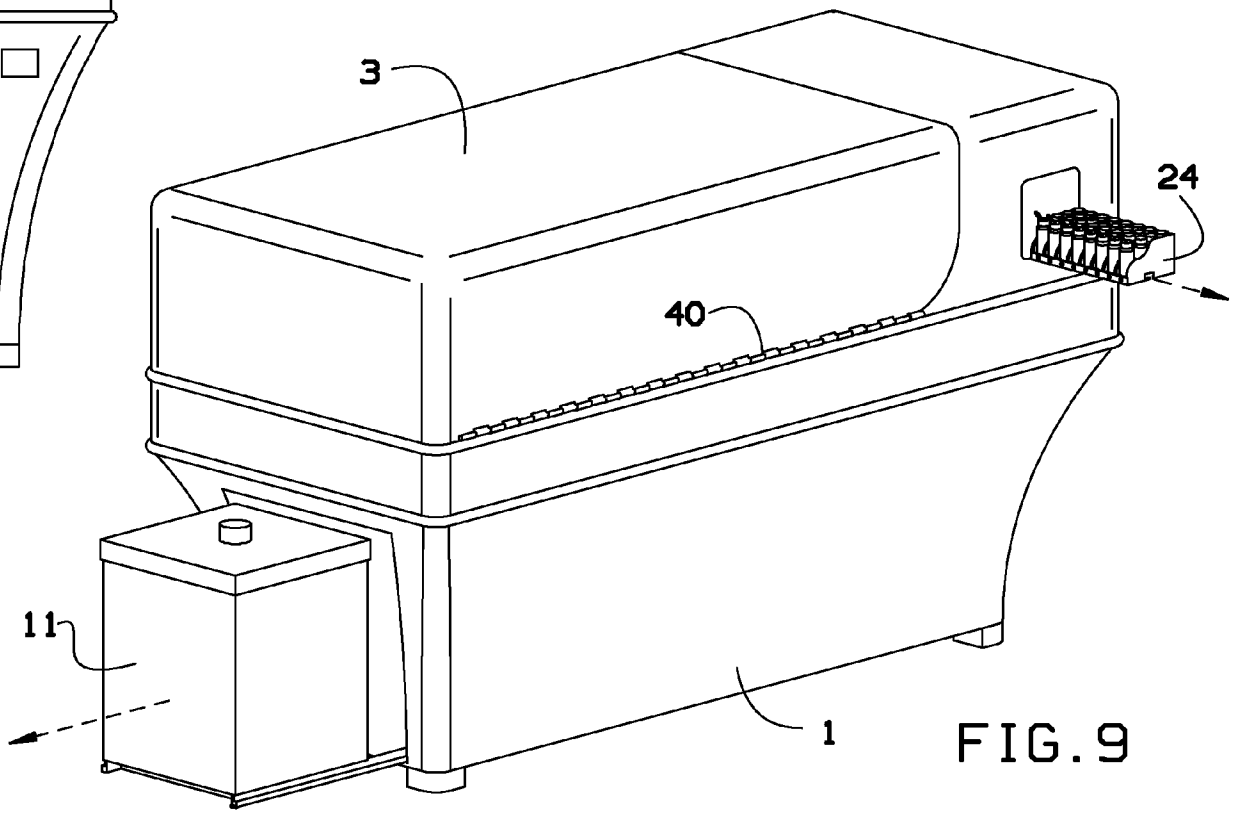
FIG. 9 is a rear perspective view of the present invention.
Figure 8:
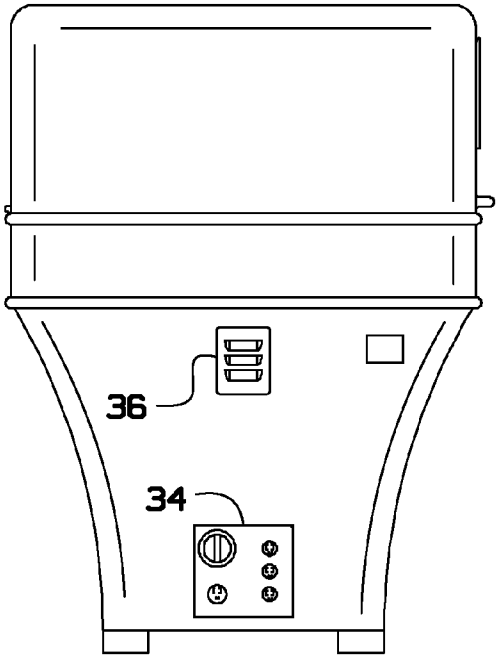
FIG. 8 is a side view of the present invention.

In certain embodiments, components may be housed within the main body outer panel 1 and the hood outer panel 2. As illustrated in FIG. 4, the main body outer panel 1 may house a vacuum 11. The vacuum 11 may be operatively connected to ventilation pan 19 underneath the table 9 by a ventilation hose 12. In such embodiments, the table 9 may be porous, and thereby the vacuum 11 may be used to dry the clothing article 38 and to remove unwanted ink from the table 9. In certain embodiments, the vacuum 11 may be easily accessed by a user for removal of waste ink. In such embodiments, the vacuum 11 may be attached to a slide platform 10 and may slide from the inside of the main body outer panel 1 to the outside of the main body outer panel 1 through an opening, as illustrated in FIG. 9. The slide platform 10 may be mounted to the main body frame 6.

In certain embodiments, other components may be housed within the main body outer panel 1. As illustrated in FIG. 4, an air intake system 13 may within the main body outer panel 1. The air intake system 13 may be attached to an intake vent 36 on the outer surface of the main body outer panel 1. The air intake system 13 may be attached to the intake vent 36 by an intake hose 14. In certain embodiments, the main body outer panel 1 may house the power module 16. The power module 16 may control the power of the unit and may be connected to the motors. An electrical port panel 34 may be operatively connected to the power module 16 and may be used to control the power module 16. The electrical port panel 34 may be located on the outside surface of the main body outer panel 1, and thereby may be easily accessed by a user. However, it is envisioned that the power module 16 and electrical port panel 34 may be located at different areas of the present invention.

Figure 3:
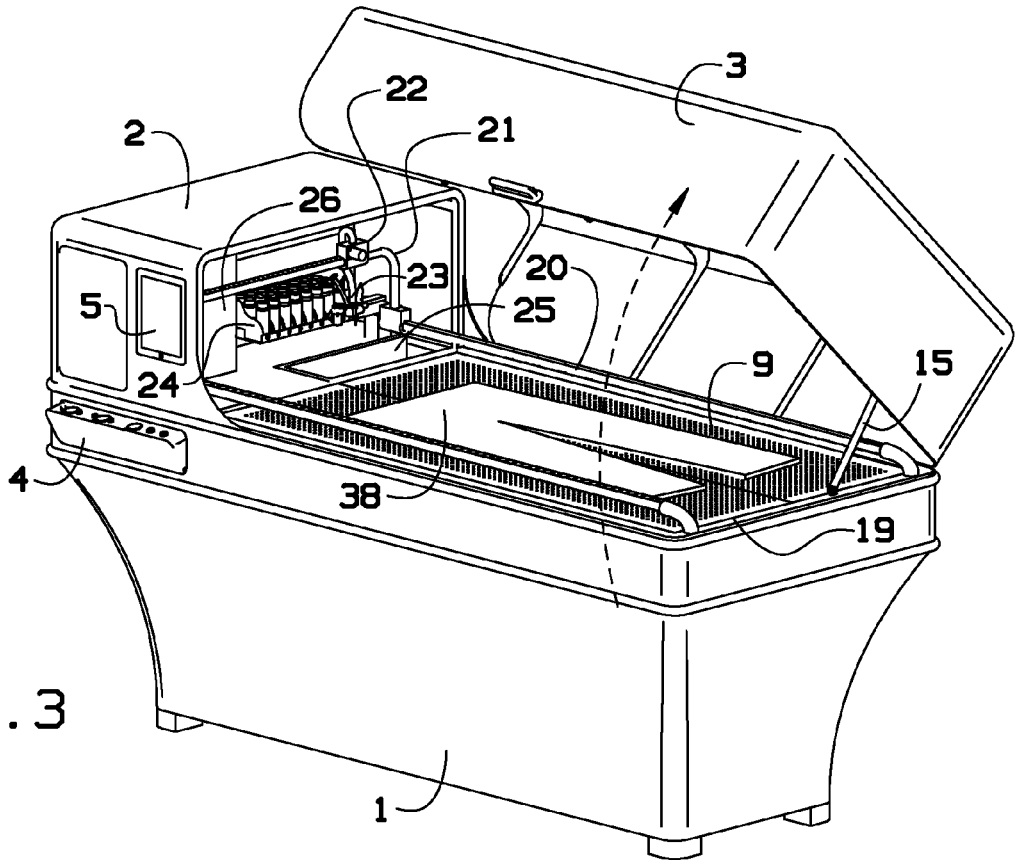
FIG. 3 is a perspective view of the present invention illustrated with the shield of FIG. 1 in an open configuration.

In certain embodiments, multiple components may be housed within the hood outer panel 2. As illustrated in FIGS. 3 and 4, the printing component may be housed within the hood outer panel 2 when the present invention is not in use. As illustrated in FIG. 9, a door or opening in the hood outer panel 2 may give access to the ink tray assembly 24. A user may thereby access the ink tray 24 using the door or opening and refill the ink cartridges 31 when needed.

The hood outer panel 2 may further include electronic components. As illustrated in FIG. 4, the hood outer panel 2 may house a processor 17. An interior panel 26 may further enclose the processor 17. A USB port module 18 may be operatively connected to the processor 17 and may enable a user to upload information to the processor 17. In certain embodiments, the processor 17 may be wirelessly connected to a tablet computer 5, which may be removably attached to the outer shell. The tablet computer 5 may be connected to the processor 17 via internet, extranet, intranet, host server, internet cloud, Bluetooth® and the like. Inputs on the tablet computer 5 may direct the processor 17 to control the present invention and produce different inputted designs on the clothing article 38. In certain embodiments, a gage panel display 4 may be operatively connected to the processor 17 to provide for manual operation and measurement of the vacuum 11 and the mechanical arm 23.

To use the present invention, the shield 3 may be opened and may be retained open by a spring, such as a gas spring 15. Clothing 38 to be custom painted may be placed on the table 9, and the shield 3 may then be closed. A desired design and coordinates may be inputted into the processor 17 using the tablet computer 5 or any input mechanism. The processor 17 may direct the mechanical arm 23 to apply paint to the clothing. Unused paint may be removed from the machine through use of the vacuum 11. The paint may be supplied to the robotic grip by the ink tray assembly 24, and the ink spray heads attached to the bottom of the mechanical arm 23 may be cleaned through the use of the spray-off tray 25.

The paint may be placed into the ink tray assembly and then slid into the machine. The machine may be connected to 110 volts (wall plug). The tablet computer may be connected to the device wirelessly or using the USB Port Module. The machine may be turned on and the pressure may be checked via the gage panel. The shield lid may be lifted, a clothing apparel may be placed on the table, and then the shield may be closed. The tablet may download the desired design. The application may be launched to operate the robotic grip assembly. The painting process may then begin. The painting process may be monitored by viewing the operation through the clear shield. Once the painting is completed and the residual paint has been removed by the vacuum, the shield may be opened and the clothing may be removed.

In certain embodiments, the customer may only need to access the graphical website, select or create a custom artistic design that he/she wishes to have painted on his/her clothing. The machine owner then takes the clothing to the machine and completes the painting process.

It should be understood, of course, that the foregoing relates to exemplary embodiments of the invention and that modifications may be made without departing from the spirit and scope of the invention as set forth in the following claims.

What is claimed is:

1. A paint station comprising:

a frame support;

a table having a length and a width, wherein the table is suspended on the frame support;

a track having a first end and a second end, wherein the track runs along at least a portion of the length of the table;

a bridge having a first end and a second end, wherein the first end is movably attached to the track, wherein the bridge extends across at least a portion of the width of the table, wherein the bridge is configured to move between the first end of the track and the second end of the track;

a printing component comprising a mechanical arm and an ink cartridge tray, wherein the ink cartridge tray is fixed to the bridge and the mechanical arm is movably attached to the bridge between the first end of the bridge and the second end of the bridge, wherein the mechanical arm comprises a neck movably attached to the bridge, wherein the neck is configured to move between the first end of the bridge and the second end of the bridge, a pivoting base attached to the neck, a siphon arm attached to the pivoting base, wherein the pivoting base pivots the siphon arm, a siphon head to the siphon arm near the opposite end of the pivoting base, and an air brush attached to a bottom of the pivoting base;

at least one motor operatively connected to the bridge and the printing component, wherein the at least one motor drives the movement of the bridge along the track and drives the movement of the printing component along the bridge; and at least one processor operatively connected to the bridge and printing component, wherein the at least one processor controls the movement of the bridge along the track and the at least one processor controls the movement of the printing component along the bridge.

2. The paint station of claim 1, wherein the table comprises a first side and a second side, and wherein the track comprises a first rail and a second rail, wherein the first rail runs along a substantial portion of a length of the first side and the second rail runs along a substantial portion of a length of the second side.

3. The paint station of claim 2, wherein the first end of the bridge is attached to the first rail and the second end of the bridge is attached to the second rail.

4. The paint station of claim 1, wherein the mechanical arm further comprises an engaging clamp attached to the pivoting base, wherein the engaging clamp is configured to engage and secure an individual ink cartridge.

5. The paint station of claim 1, wherein the frame support comprises a main body frame and a frame hood.

6. The paint station of claim 5, further comprising a main body outer panel covering the main body frame and a hood outer panel covering the frame hood.

7. The paint station of claim 6, further comprising a shield hinged to the frame, wherein the shield is in an open position and a closed position, wherein the open position comprises access to the table and the closed position comprises the shield conforming with the hood outer panel and closing off the table.

8. The paint station of claim 6, wherein the table is a porous table.

9. The paint station of claim 8, further comprising a vacuum assembly housed within the main body outer panel, wherein the vacuum assembly comprises:

a vacuum;

a vacuum hose connected to the vacuum; and a ventilation pan attached to the vacuum hose and secured underneath the porous table.

10. The paint station of claim 9, wherein the vacuum is secured to the frame by a slide platform and the main body outer panel comprises an access port, wherein the slide platform is adjacent to the access port.

11. The paint station of claim 6, further comprising a ventilation system housed within the main body outer panel.

12. The paint station of claim 6, wherein the printing component is housed within the hood panel outer covering when the paint station is in an off position.

13. The paint station of claim 12, furthering comprising an access port in the hood panel outer covering, wherein the ink cartridge tray of the printing component is positioned adjacent to the access port in the off position.

14. The paint station of claim 1, further comprising a power module operatively connected to the computer and the motor.

15. The paint station of claim 1, further comprising a tablet computer operatively connected to the processor.

16. The paint station of claim 1, further comprising gage panel display operatively connected to the processor.

* * * * *